United States Patent [19]

Euskirchen

[11] 4,238,187

[45] Dec. 9, 1980

[54] WASTE HEAT RECOVERY SYSTEM

[75] Inventor: Jürgen Euskirchen, Feldolling, Fed. Rep. of Germany

[73] Assignee: Messerschmitt-Bölkow-Blohm GmbH, Munich, Fed. Rep. of Germany

[21] Appl. No.: 20,708

[22] Filed: Mar. 15, 1979

[30] Foreign Application Priority Data

Mar. 25, 1978 [DE] Fed. Rep. of Germany ..... 2813133

[51] Int. Cl.[3] ..... F27D 10/02; F27B 7/38

[52] U.S. Cl. ..... 432/116; 432/177; 165/86; 165/96

[58] Field of Search ..... 432/103, 105, 116, 177, 432/77, 78; 126/400; 165/86, 96

[56] References Cited

U.S. PATENT DOCUMENTS

| | | | |
|---|---|---|---|
| 2,136,626 | 11/1938 | Lind | 165/86 |
| 3,369,541 | 2/1968 | Thomason | 126/400 |
| 3,595,476 | 7/1971 | Eaton | 237/8 |
| 3,876,367 | 4/1975 | Vorobeichikov et al. | 432/116 |
| 4,129,360 | 12/1978 | Deflandre et al. | 126/270 |
| 4,137,038 | 1/1979 | Vorobeichikov et al. | 432/116 |
| 4,141,154 | 2/1979 | Buchner | 432/77 |

*Primary Examiner*—Henry C. Yuen
*Attorney, Agent, or Firm*—McGlew & Tuttle

[57] ABSTRACT

A heat recovery system for use with a rotatable cylindrical kiln having a curved sidewall surface and which is adapted to be fired, for example, by a burner supplied through a fuel supply line with fuel oil, comprises, at least one segment member which overlies and is spaced from the kiln curved sidewall surface and which defines a heat radiation absorbing surface. A coolant circulating system is connected to the segment member and a coolant is circulated therethrough and then into a separate heat exchanger which is used for recovering the heat. The heat exchanger may be employed, for example, to preheat the oil which is delivered to a burner for firing the kiln or it may be used in a separate system requiring heat. A segment member is advantageously mounted on an undercarriage so that it may be moved toward or away from the kiln surface in accordance with the heat exchange requirements. In addition, it advantageously functions as a sound-absorber to prevent the transmission of noise from the kiln in the direction of the segment member.

13 Claims, 1 Drawing Figure

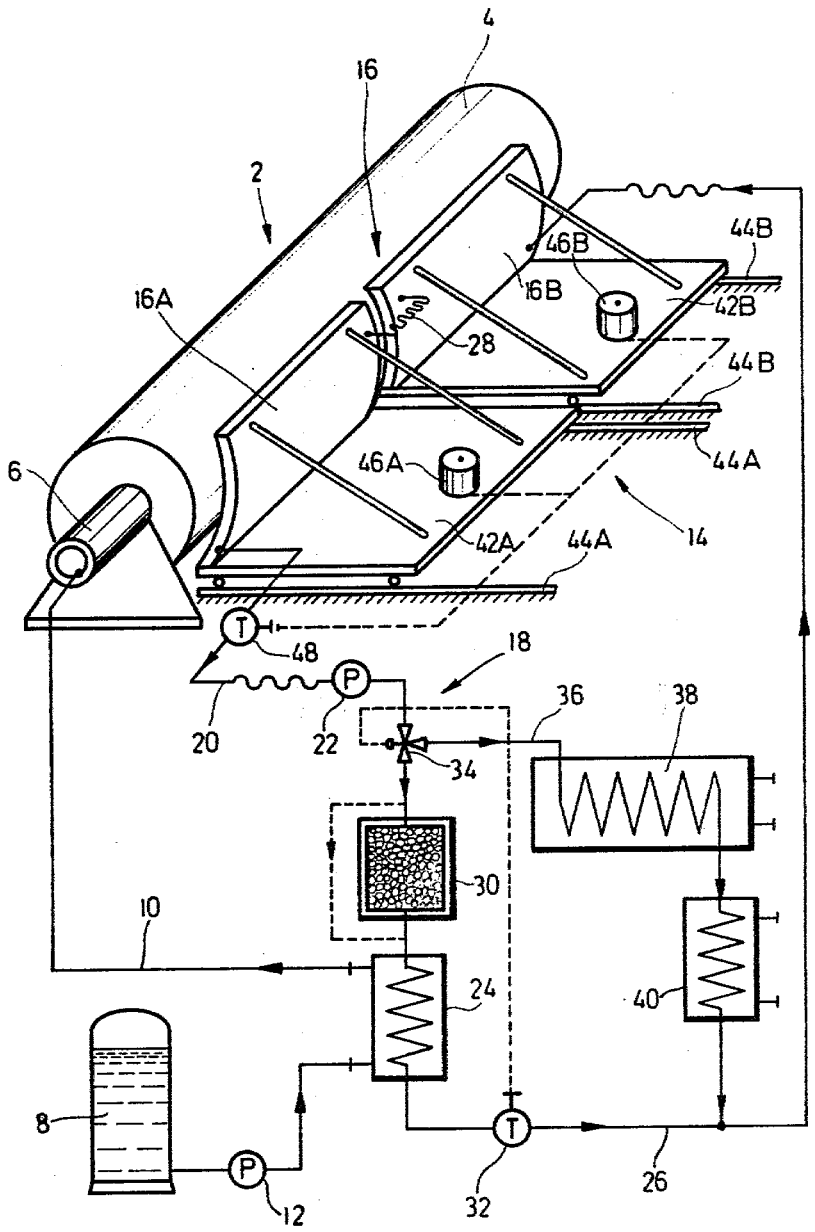
4
16
2
46B
44B
16B
42B
16A
28
44B
44A
6
46A
14
42A
44A
T
48
18
P
36
38
20
22
34
30
10
24
40
8
T
26
P
12
32

WASTE HEAT RECOVERY SYSTEM

FIELD AND BACKGROUND OF THE INVENTION

This invention relates to rotary kiln devices in general and, in particular, to a new and useful waste heat recovery system for a heat emitting structure, particularly an exposed industrial furnace.

DESCRIPTION OF THE PRIOR ART

In industrial furnaces fueled with primary energy, such as oil or coal-fired furnaces, it is known to recycle a part of the waste heat as useful heat into the process. For example, in the production of cement clinker employing heavy oil fired rotary kilns, the waste heat is utilized for preheating and procalcining the starting material, and the residual heat of the product is used for preheating the combustion air. Nevertheless, the utilization factor of primary energy carriers in industrial furnaces and other heat generating installations where chemical and thermodynamic processes take place at elevated temperatures, is small and the waste heat amounts obtained in larger plants represent a considerable environmental nuisance. This applies particularly to cement production which is considered to be one of the raw material processing industries with the highest comsumption of primary energy.

SUMMARY OF THE INVENTION

The present invention is directed to a waste heat recovery system for plants of this kind, ensuring an improved utilization of the primary energy carriers and reducing the excessive long-term environmental load, which is caused by large waste heat sources, to a tolerable level.

To this end, the invention provides a waste heat recovery system comprising a heat radiation collector spaced from and at least partly surrounding the external surface of the heat emitting structure, and a heat exchanger delivering useful heat and heated by the collector.

In accordance with the invention, the heat amount radiated toward the outside by the heat emitting structure, for example, the shell of a blast furnace, rotary kiln, or reduction furnace, and representing a considerable portion of the total waste heat and a heat loss annoying the ambience, is at least partly recovered by the radiation collector and, while saving primary energy, is reused as effective heat, preferably in the heat generating plant associated with the radiation collector, or in another heat-consuming device, for example, for the operation of a distilling plant.

Upon mounting of the radiation collector, the temperature conditions at the furnace shell or at the outside surface of the heat emitting structure remain substantially unchanged and can be maintained without disturbing the natural convective and radiant cooling of the furnace shell, provided that the area and the absorption capacity of the collector surface, as well as the air gap between the collector and the furnace shell, are correspondingly dimensioned. In this way, if desired, the natural blast cooling of the furnace shell is not affected more by the inventive recovery of the radiated waste heat than by a provision of hot-air exchangers in the convective air current serving, maybe even in addition, as a means for recovering the respective portion of the waste heat.

In a particularly preferred application of the invention, the radiation collector is associated with a heavy-oil-fired industrial furnace, e.g., a rotary cement kiln, and the heat exchanger is used for preheating the heavy oil. Here, another particular advantage of the invention becomes manifest. In the cement production in heavy-oil-fired kilns, a portion of the oil itself is usually burned to effect the preheating and, unlike the $SO_2$ content forming in the process proper of burning the preheated oil, the $SO_2$ gases produced during the combustion do not combine with the cement raw materials. However, the heavy oil preheating manner, in accordance with the invention, completely eliminates an emission of $SO_2$ and, in addition to saving heavy oil, further reduces costs by making it possible to dispense with the hitherto required boilers for preheating the heavy oil, which have a short life since the sulfur content of the burned oils is very high.

Preferably, a modular design is provided and the radiation collector is subdivided into a plurality of separate, radiation absorbing plate-shaped segments facing the external surface of the heat-emitting structure, so that the inventive system can be equipped in a simple manner with collectors of different size and adapted to furnaces or heat-emitting structures of different types.

The inventive recovery system further offers the particularly simple possibility of controlling the temperature or the heat amount absorbed by the collector. For this purpose, the radiation collector, or its individual segments are mounted for displacement so as to be able to vary their spacing from the external surface of the heat emitting structure and to thus control the incident heat radiation. This also makes it possible to retract the collector from the radiation range of the furnace wall as soon as an admissible upper temperature limit is reached and to an extent such that an emergency cooling becomes unnecessary.

In order to eliminate the annoyance of the environment not only by the waste heat and/or noxious substances ($SO_2$) but also by sound, it is advisable to design the radiation collector as a sound-absorbing structure.

The radiation collector and the heat exchanger may be designed as a constructional unit. However, in many applications, it will be advantageous to install them separately and connect them to each other by a high-pressure or low-pressure circuit, preferably a closed liquid circuit.

To compensate for temporary temperature variations of the heat carrying fluid heated in the radiation collector, a heat buffer is advantageously provided in the path of the circuit. In addition, a selectively connectable long-term heat exchanger is advantageously provided in the path of the heat conveying circuit, for periods in which the heat amount absorbed by the collector would be higher than the heat consumption in the heat exchanger for the useful heat, which additional exchanger may also be used as a heat source for other purposes, for example, for heating the heavy oil at the start of operating the heat generating plant. Finally, a residual excess heat amount which might have remained in the heat conveying circuit may also be utilized by means of the selectively connectable additional heat exchanger.

Accordingly, an object of the present invention is to provide a heat recovery system for use with a rotatable cylindrical kiln having a curved sidewall surface and which is adapted to be fired for operation thereof, which comprises at least one segment member which overlies and is spaced from the kiln curved sidewall surface and defines a heat radiation absorbing surface and means for circulating a coolant through the segment member and out of the segment member and then back to the segment member and heat exchanger means associated with the circulator means exteriorly of the segment member for transferring the heat received by the coolant.

A further object of the invention is to provide a waste heat recovery system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a schematic elevational view of a rotary kiln cement plant having a waste heat recovery system constructed in accordance with the present invention.

DESCRIPTION OF THE PREFERRED EMBODIMENT

Referring to the drawing in particular, the invention embodied therein, comprises, a heat recovery system for use with a rotatable cylindrical kiln, generally designated 2, having a curved sidewall surface and with a centrally fired burner 6 for carrying out a high temperature reaction within the kiln. In accordance with the invention, at least one segment member 16 is provided which comprises a radiation receiving surface which is similarly curved, spaced from and overlies a portion of the curved wall of the kiln 2 and defines a heat radiation-absorbing surface.

In accordance with the invention, circulating means 18 are provided for circulating the coolant through the radiation collector 16 and also for circulating the coolant through heat exchanger means which comprises one or more heat exchangers 24 or 38. The rotary kiln 2, in which the starting materials for producing cement are calcined and sintered at an operating temperature of about 1000° C., comprises as main component parts a rotary kiln cylinder or shell 4 and an oil burner 6. The oil burner 6 is supplied with heavy oil which has a primarily high sulfur content from an oil tank 8 through an oil supply line 10 and by means of a pump 12 provided in the line. The $SO_2$ gases produced in rotary kiln 2 by burning of the heavy oil, which is preheated in a manner described hereinbelow, combine with the cement raw materials within kiln 2.

A waste heat recovery system 14 is associated with rotary kiln 2 and a portion of the waste heat radiated by kiln shell 4 at the operating temperature is transformed into useful heat and a radiation collector 16, subdivided in a plurality, as shown in the example, of two individual segments 16A and 16B. The segments are positioned at a uniform radial distance from the kiln shell 4 and surround the shell over a considerable portion of its cylindrical surface and, in the embodiment shown, the segments extend through an angle of about 120° and substantially over the entire length of the kiln.

The radiation absorbing surfaces of collector segments 16A and 16B facing kiln shell 4 preferably have a high absorptive capacity approaching, as far as possible, that of a black body and are of a design such that the cooling effect on the kiln shell surface areas passing collector 16, and due to the heat transfer by radiation and convection, is substantially equal to the cooling effect on the free, non-surrounded surface areas of shell 4, which is due to the heat transfer by radiation and convection, too. Advantageously, collector segments 16A and 16B are designed as cylindrically curved plates having a radius of curvature exceeding that of the outer surface of kiln shell 4 by the mean width of the air gap between shell 4 and the surface of the collector.

Collector segments 16A and 16B are cooled by a closed high pressure or low pressure liquid cooling circuit 18 by which the heat radiation incident on the collector surfaces is conveyed in the form of sensible heat through a flow line 20 connected to collector segment 16A and a circulating pump 22 to a countercurrent effective heat exchanger 24 where the heavy oil to be supplied by pump 12 to burner 6 is preheated to the required temperature. The liquid is circulated through a return line 26 from effective heat exchanger 24 to collector segment 16B and, from there, it is circulated through a flexible connection 28 back to the collector segment 16A.

Closely upstream of effective heat exchanger 24, a heat buffer 30 is provided in the path of circuit 18 in which temporary variations of the flow temperature or a short term increase in heat consumption of the effective heat exchanger caused by an instantaneous higher rate of flow of the heavy oil are compensated. During the starting phase, heat buffer 30 is bridged by a bypass shown in dotted lines, to avoid a delay in the preheating of the heavy oil in exchanger 24. If the heat absorbed by collector 16 during the operation and after saturation of heat buffer 30 is larger than the heat consumption in effective heat exchanger 24, the return temperature exceeds a predetermined limit value, whereby, under the control of a temperature sensor 32 provided in return line 26, a control valve 34, connected in circuit 18 upstream of heat buffer 30, is actuated, and a corresponding portion of the liquid stream is branched from flow line 20 into a secondary line 36 which leads, through a long term heat accumulator 38 having a high thermal capacity and a following additional heat exchanger 40 to return line 26, in order to utilize the residual heat downstream of effective heat exchanger 24. Long term heat exchanger 38 may be used, for example, at the start of the plant operation for heating up the heavy oil until effective heat exchanger 24 is capable of delivering the required amount of heat, while additional heat exchanger 40 supplies the remaining residual heat to another consuming device.

If the radiation heat absorbed by collector 16 exceeds the total heat amount removed from the liquid circuit, and/or the temperature at the external surface of the kiln shell or the collector surface facing it exceeds an admissible upper limit value, the air gap between kiln shell 4 and collector 16 is enlarged. For this purpose, collector segments 16A, 16B are mounted for displacement within a predetermined distance and by means of respective undercarriages 42A and 42B supported on rails 44A and 44B. The air gap is adjusted by means of a respective drive motor 46A and 46B which are respectively mounted on undercarriages 42A and 42B and under the control of a temperature sensor 48 which is provided in flow line 20 closely downstream of collector segment 16A at the burner side, and is responsive to the deviation of the liquid temperature from a predetermined set value. In some applications, it may be sufficient to make only one collector segment movable, for example, segment 16A.

The set value for the flow temperature at the temperature sensor 48 may range from 150° C. to 200° C., while the return temperature should not exceed 140° C.

To prevent any sound emission by rotary kiln 2, radiation collector 16 is designed as a sound-absorbing element and is advantageously oriented so as to reduce the sound in the direction of neighboring residential areas.

While a specific embodiment of the invention has been shown and described in detail to illustrate the application of the principles of the invention, it will be understood that the invention may be embodied otherwise without departing from such principles.

What is claimed is:

1. A waste heat recovery system for an industrial furnace or a similar reactor, comprising a radiation collector entirely disposed outside of the outer wall of the furnace between the furnace ends and having a radiation absorbing surface for absorbing the heat radiation issuing from the furnace wall, said surface facing the outer furnace wall and surrounding it at least partly and being spaced therefrom by an air gap, a coolant circuit extending through the radiation collector to cool the radiation absorbing surface, a heat exchanger associated with said coolant circuit to dissipate the heat removed from the radiation absorbing sufface, carriage means for movably supporting said radiation collector, and drive means operatively connected to said carriage means for moving said carriage means and said collector to adjust the air gap between the outer wall and the radiation absorbing surface.

2. A waste heat recovery system, as claimed in claim 1, wherein said furnace includes an oil fired kiln, and means for supplying oil to said oil fired kiln, through said heat exchanger in a heat transfer relationship with said coolant circuit.

3. A waste heat recovery system, as claimed in claim 2 wherein said kiln is a rotatable cylindrical kiln.

4. A waste heat recovery system, as claimed in claim 3 wherein said radiation collector includes a plurality of radiation absorbing plate-shaped segments facing the kiln and spaced therefrom.

5. A waste heat recovery system for recovering waste heat from a heat emitting structure, particularly for recovering waste heat emitted from the shell of a rotary kiln of the type having a burner connected into one end of the kiln for firing the kiln which is supplied with fuel through a fuel line, comprising a radiation collector movably disposed at a spaced location from the shell, said radiation collector having a radiation absorbing surface for absorbing heat emitted from the shell, said radiation absorbing surface overlying at least a portion of said shell intermediate the ends thereof, coolant curcuit means extending through said radiation collector for passing a coolant for cooling said radiation surface, heat exchanger means operatively connected to said coolant circuit means for indirectly transferring heat from said coolant circuit means to fuel line, a second heat exchanger means operatively connected to said coolant circuit means, a temperature sensor operatively connected to said coolant circuit means downstream of said first-mentioned heat exchanger means, and control valve means disposed upstream of and controlling said coolant passage to said first-mentioned and said second heat exchanger means responsive to said temperature sensor.

6. A waste heat recovery system, according to claim 5, further comprising carriage means for movably supporting said radiation collector and drive means operatively connected to said carriage means for moving said carriage means and said collector to adjust the spacing between the shell and the radiation absorbing surface.

7. A waste heat recovery system, according to claim 6 further comprising a second temperature sensor operatively connected to said coolant circuit means and said drive means being operative to adjust said spacing responsive to said second temperature sensor.

8. A waste heat recovery system for use with a rotatable cylindrical kiln having a heat emitting curved sidewall surface and including a burner connected into one end of said kiln for firing the kiln which is supplied with fuel through a fuel supply line, comprising, at least one segment member overlying and spaced from the heat emitting curved side-wall surface of the kiln intermediate the ends thereof and defining a heat radiation-absorbing surface, whereby an air gap is formed between said side wall surface and said radiation absorbing surface, circulating means connected to said segment member for circulating a coolant therethrough, heat exchanger means associated with said circulating means exteriorly of said segment member for transferring the heat received by the coolant, said circulating means comprising a line for circulating a liquid coolant through said segment member and out of said segment member and return said coolant to said segment member in a closed circuit, said heat exchanger means including a heat exchanger in said closed circuit through which the coolant is circulated, a bypass line forming a part of said circulating line, a second heat exchanger in said bypass line and valve means for regulating the flow of the coolant into said second heat exchanger and said bypass line.

9. A waste heat recovery system, as claimed in claim 8, including a heat accumulator in said line.

10. A waste heat recovery system, as claimed in claim 8 wherein said segment member comprises a plurality of segment members arranged in spaced longitudinal relationship and overlying respective portions of the surface of said kiln.

11. A waste heat recovery system, as claimed in claim 10, including carriage means supporting said segments and being movable with the respective segments in respect to the surface of said kiln to vary the spacing therebetween and therefore control the incident heat radiation.

12. A waste heat recovery system, as claimed in claim 11, wherein said radiation collector comprises a sound-absorbing structure.

13. A waste heat recovery system, as claimed in claim 8, including a heat buffer disposed in said line.

* * * * *